US007008328B2

(12) United States Patent
Checketts

(10) Patent No.: US 7,008,328 B2
(45) Date of Patent: Mar. 7, 2006

(54) CONTROLLABLY ROTATABLE SEAT

(76) Inventor: Stanley J. Checketts, 900 E. Canyon Rd., Providence, UT (US) 84332

( * ) Notice: Subject to any disclaimer, the term of this patent is extended or adjusted under 35 U.S.C. 154(b) by 76 days.

(21) Appl. No.: 09/922,548

(22) Filed: Aug. 3, 2001

(65) Prior Publication Data

US 2003/0025368 A1 Feb. 6, 2003

(51) Int. Cl.
*A63G 1/08* (2006.01)

(52) U.S. Cl. ..... 472/29; 472/46

(58) Field of Classification Search ..... 472/44, 472/45, 46, 47, 130, 29; 273/348, 378, 407; 297/141, 142, 241
See application file for complete search history.

(56) References Cited

U.S. PATENT DOCUMENTS 2,203,971 A * 6/1940 Eyerly ..... 472/44
2,229,966 A * 1/1941 Shepherd ..... 472/45
4,410,173 A * 10/1983 Bohme ..... 472/44
5,941,777 A * 8/1999 Moser et al. ..... 472/44
6,022,276 A * 2/2000 Knijpstra ..... 472/33
6,053,576 A * 4/2000 Jessee ..... 297/344.19

* cited by examiner

*Primary Examiner*—Kien T. Nguyen
(74) *Attorney, Agent, or Firm*—Fehr Law Firm; Thompson E. Fehr

(57) ABSTRACT

A controllably rotatable seat having an arm to which one or more seats are attached. The arm is rotatably connected to a carrier. An electrical motor, pneumatics, hydraulics, or any other mechanism that is well known in the art for producing rotation rotates the arm and, consequently, the seat or seats. Initiation of rotation and returning of the seat or seats to their original orientation is accomplished by a timer, a sensor detecting targets, or the measurement of some physical criterion associated with movement of the carrier. Preferably, a lever arm connects the arm to the device for rotating so that the point of rotation of the device for rotating will be substantially aligned with the center of gravity of a participant sitting on the seat.

36 Claims, 3 Drawing Sheets

CONTROLLABLY ROTATABLE SEAT

BACKGROUND OF THE INVENTION

1. Field of the Invention

This invention relates to a rotating seat for an amusement ride.

2. Description of the Related Art

Several patents, e.g., U.S. Pat. Nos. 5,421,783; 5,649,866; and 5,810,671 have a passenger carrier that is accelerated upward by bungee cords and can relatively freely swing about the ends of such cords. There is, however, no control over any rotation of the carrier that does occur.

U.S. Pat. No. 6,083,111 does involve controlled rotation of a passenger chair (also termed a "support") for an amusement ride. The degree of rotation is, however, purposefully limited; the limited rotation that is possible apparently occurs only over a restricted, fixed portion of a course upon a tower; and only downward movement occurs when the chair has been rotated from its initial substantially vertical position.

Lines 31 through 37 in column 2 of U.S. Pat. No. 6,083,111 explain, "The passenger support, together with the passenger, is tilted forward into a falling orientation which is at a predetermined tilt-angle to the pre-fall orientation. The passenger support, together with the passenger, is dropped or propelled from the drop position to a lower position while the passenger support and the passenger are in the forward tilted falling orientation . . . . "

Lines 3 and 4 in column 3 further clarify, "for safety reasons, the tilt-angle of the passenger and the passenger support is limited . . . . "

U.S. Pat. No. 6,083,111 continues, in lines 26 through 28 of column 3, by asserting, "A travel course for the carriage is established by engaging a guide that is connected to the carriage upon an elongate rail or track that is coupled to an elevating tower."

Lines 23 through 25, 39 through 42, and 46 through 49 of column 3 state, "The degree of tilt between the pre-fall orientation 92 and the falling orientation 95 is predetermined and restricted . . . . When the latching mechanism 40 is released, the passenger support 22 is permitted to tilt or be tilted from the pre-fall orientation 92 toward and into the falling orientation 95. Alternatively, the tilting action can be induced by an operating mechanism B43B which in the described embodiment is a rotary motor and may be exemplarily electromechanical, hydraulic or other suitable configuration."

Lines 39 through 46 and 55 through 57 of column 6 consistently provide, "Upon reaching the drop position 70, the passenger support 22 is permitted to tilt, or is tilted from the upright and sitting pre-fall orientation 92 to the tilted falling orientation 95. To accomplish such tilting, the latching mechanism 40 is released and the passenger 55 is either motored to the tilted position using the operating mechanism 43 or the support 22 is simply allowed to drop to the tilted position and falling orientation 95 under the passenger's 55 own weight . . . . The tilting action is accommodated by the pivot connection 37 and is limited either by the operating mechanism 43 or appropriate stops." Then line 67 of column 3 through line 2 of column 7 declares, "Either simultaneously or shortly thereafter, the carriage 34 begins to drop over a falling travel distance 73."

Finally, lines 53 through 56 in column 7 observe, "The maximum safe tilt angle 98 is experimentally determined and then the actual tilt angle 98 is restricted within a range between that determined angle and the upright position."

SUMMARY OF THE INVENTION

The Controllably Rotatable Seat, which may be a single seat or several seats, of the present invention can be rotated at any time during the operation of an amusement ride upon which it is attached. Furthermore, this seat is able to be rotated at least substantially ninety degrees.

The seat need not be attached by a track to a tower and is, preferably, attached to a platform that is support by cables, preferably three. Each of such cables travels to an elevated point on a tower. In such an embodiment, the platform is elevated as the cables are retracted down the towers.

Rotation of the seat may be accomplished by an electrical motor, pneumatics, hydraulics, or any other mechanism that is well known in the art for producing rotation.

Rotation can be based upon the seat's having reached a target detectable with a proximity sensor; the passage of time; the seat's having reached a height measured with any device known in the art for measuring distances, such as a laser range finder; a cable's having moved a specified distance, which can be determined, for example, by noting the revolutions of a pulley over which the cable passes; or any other measurable criterion, such as a desired speed or acceleration. Determination of the time for rotating the seat to its original position can be similarly made.

DESCRIPTION OF THE PREFERRED EMBODIMENT

Figure 1:
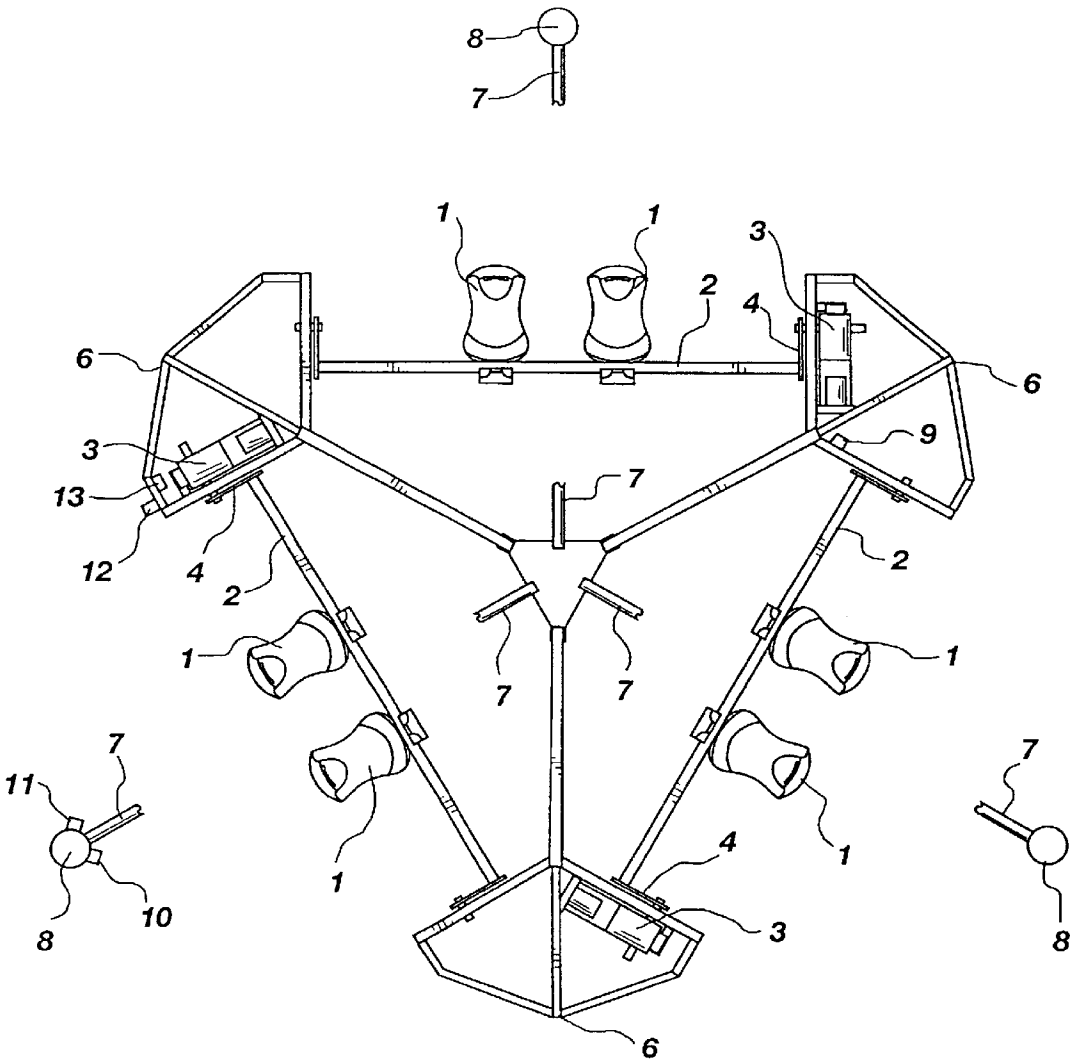
FIG. 1 shows a first view of the Controllably Rotatable Seat.
Figure 2:
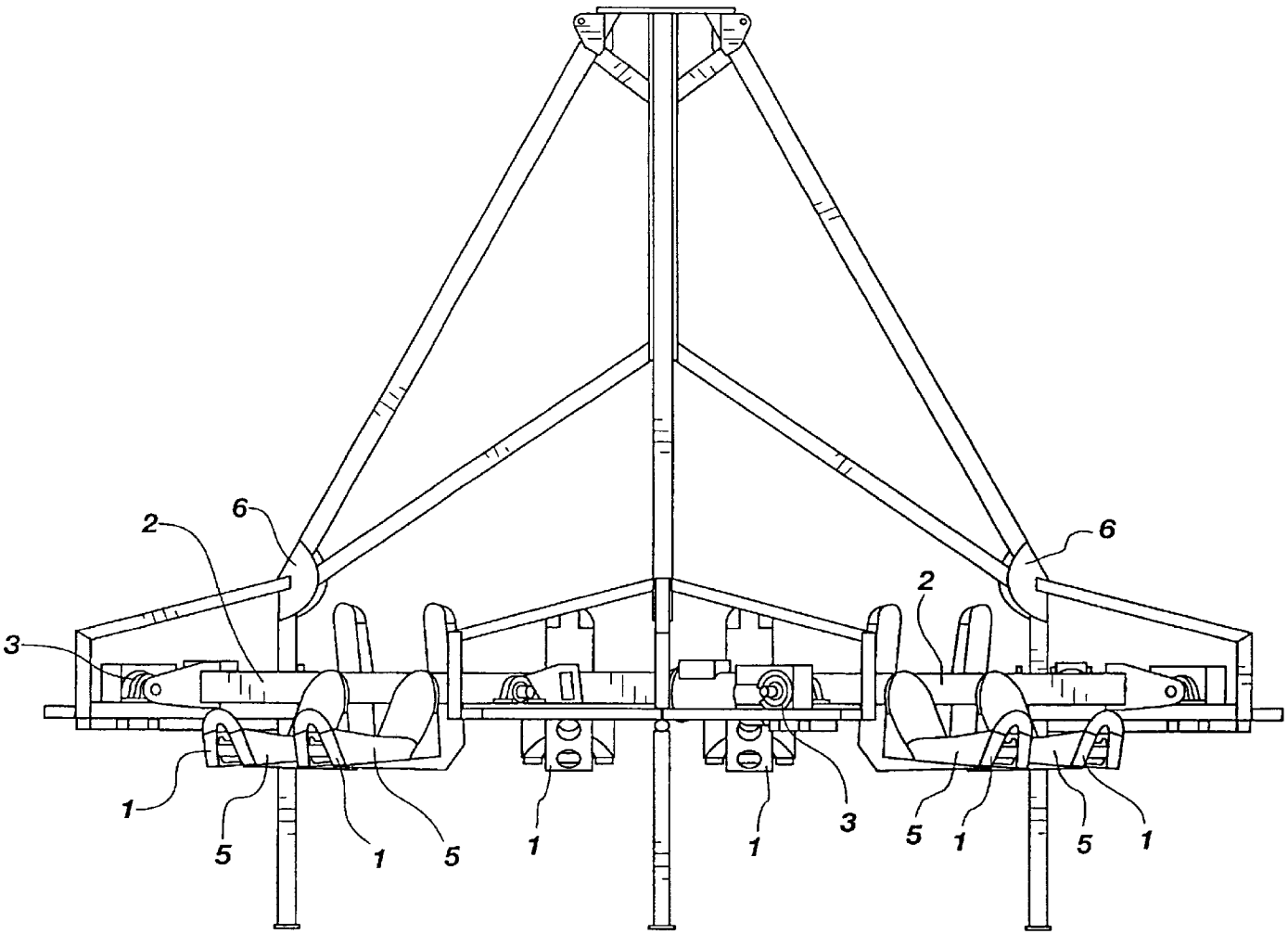
FIG. 2 provides an alternate view of the Controllably Rotatable Seat.
Figure 3:
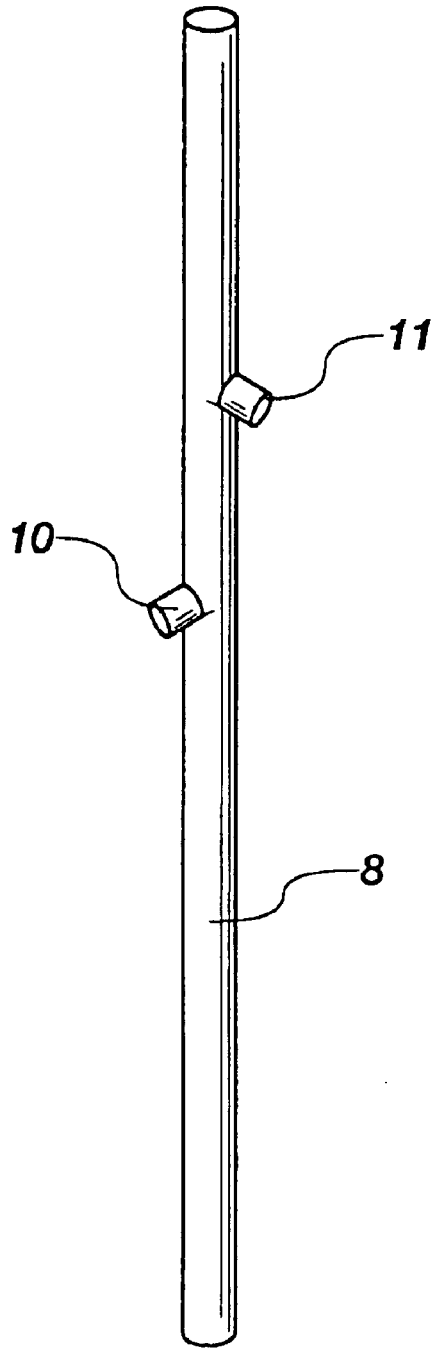
FIG. 3 depicts a target on a tower to be detected by a sensor associated with the Controllably Rotatable Seat.

The seat 1 is attached to an arm 2 that is rotated by a means for rotating 3 which is preferably an electric motor but which can be pneumatics, hydraulics, or any other mechanism that is well known in the art for producing rotation. (The term "seat" is used herein to mean either a single seat or a group of two or more seats.)

Preferably, but not necessarily, a lever arm 4 connects the arm 2 to the means for rotating 3 so that the point of rotation of the means for rotating 3 will be substantially aligned with the center of gravity of a participant sitting on the seat 1.

Also preferably, but not necessarily, the lower portion 5 of the seat 1 is a saddle seat, i.e., it is formed in substantially the same shape as a saddle for a horse, in order to cause the participant to feel exposed to excitement.

The arm 2 and, consequently, the seat 1 can preferably, but not necessarily, rotate at least ninety degrees.

Preferably, but not necessarily, there would also be a means for retaining the participant to the seat 1, such as a harness.

The arm 2 and the means for rotating 3, as well as the lever arm 4 when employed, are attached to a platform 6, which can be slidably connected to a vertical tower or placed upon any other amusement ride (in fact, some rides, such as the car of a roller coaster, can, themselves, serve as the platform 6), but which is preferably connected to cables 7 that are suspended from towers 8, preferably, but not necessarily three towers. As explained above, each of the cables 7 travels to an elevated point on a tower 8; and the platform 6 is elevated as the cables 7 are retracted down the towers 8. Attachment of the arm 2, and the lever arm 4 when employed, is a rotatable attachment to the platform 6.

A timer 9 communicating with the means for rotating 3 can be programmed with the time to commence rotation and the time to begin rotating the seat 1 to its original orientation.

Alternatively, a target 10 can be located on a tower 8 or other object at a point where rotation is desired to commence as the seat 1 passes the target 10, and a second target 11 can be placed on a tower 8 or other object at a point where it is desired to have the seat 1 start rotating back to its original orientation. A sensor 12 capable of detecting the targets 10, 11 would be mounted on the platform 6 and communicate either directly or through a preferably, but not necessarily, programmable, logic unit 13 such as a computer with the means for rotating 3. Optionally, only a single target 10 would be employed; and the seat 1 would start rotating as it passed the target 10 going in a first direction and would begin rotating to its original orientation as it passed the target 10 going in the substantially opposite direction.

A device known in the art for measuring distances could also determine the distance between a known elevation (or other position) and the platform 6. Such device communicates through a, preferably, but not necessarily, programmable, logic unit 13 such as a computer with the means for rotating 3. Initial rotation would commence at a given distance, and rotation back to the original orientation of the seat 1 would begin at another specified distance, with such criteria either set into the logic unit 13 at the factory or, when the logic unit is programmable, programmed into the logic unit 13 by a user. Communication in this embodiment would preferably, but not necessarily, be by digitally encoded radio signals.

Finally, when cables 7 are employed to propel the platform 6, any device well known in the art for measuring the distance a cable 7 moves could function just as does the device for measuring distances discussed in the preceding paragraph.

Also, as discussed above, any device known in the art for measuring speed or acceleration or any other measurable criterion associated with the amusement ride could determine the time for rotation and the time for return of the seat 1 to its original orientation just as discussed for the device for measuring distances.

I claim:

1. A controllably rotatable seat, which comprises:

a seat;

an arm attached to said seat;

a means for rotating said arm and said seat, said means for rotating having a point of rotation;

a platform, said arm being rotatably attached to said platform and said means for rotating being connected to said platform; and a means for directing that rotation occur and directing that said seat and said arm be returned substantially to the pre-rotation orientation of said arm and said seat.

2. The controllably rotatable seat as recited in claim 1, further comprising:

a lever arm that connects said arm to said means for rotating so that the point of rotation of the means for rotating will be substantially aligned with the center of gravity of a participant sitting in said seat.

3. The controllably rotatable seat as recited in claim 2, wherein:

said means for directing comprises a timer in communication with said means for rotating.

4. The controllably rotatable seat as recited in claim 2, wherein:

said means for directing comprises:

one or more targets; and a sensor capable of detecting said targets, said sensor communicating with said means for rotating.

5. The controllably rotatable seat as recited in claim 2, wherein:

said means for directing comprises:

a means for measuring a physical quantity selected from the physical quantities consisting of distance, speed, and acceleration; and a logic unit through which the means for measuring communicates with the means for rotating.

6. The controllably rotatable seat as recited in claim 5, wherein:

said logic unit is programmable.

7. The controllably rotatable seat as recited in claim 2, wherein:

said arm and, consequently, said seat rotates at least ninety degrees.

8. The controllably rotatable seat as recited in claim 7, wherein:

said means for directing comprises a timer in communication with said means for rotating.

9. The controllably rotatable seat as recited in claim 7, wherein:

said means for directing comprises:

one or more targets; and a sensor capable of detecting said targets, said sensor communicating with said means for rotating.

10. The controllably rotatable seat as recited in claim 7, wherein:

said means for directing comprises:

a means for measuring a physical quantity selected from the physical quantities consisting of distance, speed, and acceleration; and a logic unit through which the means for measuring communicates with the means for rotating.

11. The controllably rotatable seat as recited in claim 10, wherein:

said logic unit is programmable.

12. The controllably rotatable seat as recited in claim 7, further comprising:

a means for retaining a participant to said seat.

13. The controllably rotatable seat as recited in claim 12, wherein:

said means for directing comprises a timer in communication with said means for rotating.

14. The controllably rotatable seat as recited in claim 12, wherein:

said means for directing comprises:

one or more targets; and a sensor capable of detecting said targets, said sensor communicating with said means for rotating.

15. The controllably rotatable seat as recited in claim 12, wherein:

said means for directing comprises:

a means for measuring a physical quantity selected from the physical quantities consisting of distance, speed, and acceleration; and a logic unit through which the means for measuring communicates with the means for rotating.

16. The controllably rotatable seat as recited in claim 15, wherein:

said logic unit is programmable.

17. The controllably rotatable seat as recited in claim 2, further comprising:

a means for retaining a participant to said seat.

18. The controllably rotatable seat as recited in claim 17, wherein:

said means for directing comprises a timer in communication with said means for rotating.

19. The controllably rotatable seat as recited in claim 17, wherein:

said means for directing comprises:

one or more targets; and a sensor capable of detecting said targets, said sensor communicating with said means for rotating.

20. The controllably rotatable seat as recited in claim 17, wherein:

said means for directing comprises:

a means for measuring a physical quantity selected from the physical quantities consisting of distance, speed, and acceleration; and a logic unit through which the means for measuring communicates with the means for rotating.

21. The controllably rotatable seat as recited in claim 20, wherein:

said logic unit is programmable.

22. The controllably rotatable seat as recited in claim 1, wherein:

said arm and, consequently, said seat rotates at least ninety degrees.

23. The controllably rotatable seat as recited in claim 22, wherein:

said means for directing comprises a timer in communication with said means for rotating.

24. The controllably rotatable seat as recited in claim 22, wherein:

said means for directing comprises:

one or more targets; and a sensor capable of detecting said targets, said sensor communicating with said means for rotating.

25. The controllably rotatable seat as recited in claim 22, wherein:

said means for directing comprises:

a means for measuring a physical quantity selected from the physical quantities consisting of distance, speed, and acceleration; and a logic unit through which the means for measuring communicates with the means for rotating.

26. The controllably rotatable seat as recited in claim 25, wherein:

said logic unit is programmable.

27. The controllably rotatable seat as recited in claim 22, further comprising:

a means for retaining a participant to said seat.

28. The controllably rotatable seat as recited in claim 27, wherein:

said means for directing comprises a timer in communication with said means for rotating.

29. The controllably rotatable seat as recited in claim 27, wherein:

said means for directing comprises:

one or more targets; and a sensor capable of detecting said targets, said sensor communicating with said means for rotating.

30. The controllably rotatable seat as recited in claim 27, wherein:

said means for directing comprises:

a means for measuring a physical quantity selected from the physical quantities consisting of distance, speed, and acceleration; and a logic unit through which the means for measuring communicates with the means for rotating.

31. The controllably rotatable seat as recited in claim 30, wherein:

said logic unit is programmable.

32. The controllably rotatable seat as recited in claim 1, further comprising:

a means for retaining a participant to said seat.

33. The controllably rotatable seat as recited in claim 32, wherein:

said means for directing comprises a timer in communication with said means for rotating.

34. The controllably rotatable seat as recited in claim 32, wherein:

said means for directing comprises:

one or more targets; and a sensor capable of detecting said targets, said sensor communicating with said means for rotating.

35. The controllably rotatable seat as recited in claim 32, wherein:

said means for directing comprises:

a means for measuring a physical quantity selected from the physical quantities consisting of distance, speed, and acceleration; and a logic unit through which the means for measuring communicates with the means for rotating.

36. The controllably rotatable seat as recited in claim 35, wherein:

said logic unit is programmable.

* * * * *